US009548553B2

(12) United States Patent
Glick et al.

(10) Patent No.: US 9,548,553 B2
(45) Date of Patent: Jan. 17, 2017

(54) TERMINAL WITH FRONT END PROTECTION

(71) Applicant: Lear Corporation, Southfield, MI (US)

(72) Inventors: Michael Glick, Farmington Hills, MI (US); Slobodan Pavlovic, Novi, MI (US); Tulasi Sadras-Ravindra, Canton, MI (US)

(73) Assignee: LEAR CORPORATION, Southfield, MI (US)

( * ) Notice: Subject to any disclaimer, the term of this patent is extended or adjusted under 35 U.S.C. 154(b) by 0 days.

(21) Appl. No.: 14/168,068

(22) Filed: Jan. 30, 2014

(65) Prior Publication Data

US 2014/0273659 A1 Sep. 18, 2014

Related U.S. Application Data

(60) Provisional application No. 61/786,726, filed on Mar. 15, 2013.

(51) Int. Cl.

| | |
|---|---|
| ***H01R 4/48*** | (2006.01) |
| ***H01R 13/11*** | (2006.01) |
| ***H01R 13/18*** | (2006.01) |

(52) U.S. Cl.

CPC ..... *H01R 13/113* (2013.01); *H01R 13/18* (2013.01)

(58) Field of Classification Search

CPC ..... H01R 13/19; H01R 13/111; H01R 13/187; H01R 13/115; H01R 13/113; H01R 4/4809; H01R 13/2442

USPC ..... 439/839, 842, 843, 845, 849–852, 861,439/862

See application file for complete search history.

(56) References Cited

U.S. PATENT DOCUMENTS

| | | | | |
|---|---|---|---|---|
| 2,774,951 | A | | 12/1956 | Kinkaid et al. |
| 2,921,287 | A | | 1/1960 | Matthysse et al. |
| 3,550,069 | A | | 12/1970 | Teagno |
| 4,553,808 | A | | 11/1985 | Weidler et al. |
| 4,570,147 | A | | 2/1986 | Ebi |
| 4,646,052 | A | | 2/1987 | Matsunaga et al. |
| 4,672,352 | A | | 6/1987 | Takano |
| 4,751,490 | A | | 6/1988 | Hatagishi |
| 4,842,534 | A | | 6/1989 | Mobley et al. |
| 4,869,972 | A | | 9/1989 | Hatagishi |
| 4,871,990 | A | | 10/1989 | Ikeda et al. |
| 4,934,965 | A | * | 6/1990 | Buddrus et al. ..... 439/845 |
| 4,941,851 | A | | 7/1990 | Hsueh |
| 4,958,426 | A | | 9/1990 | Endo et al. |
| 5,035,661 | A | | 7/1991 | Steinhardt et al. |
| 5,088,940 | A | | 2/1992 | Saito |
| 5,147,230 | A | | 9/1992 | Plyler et al. |

(Continued)

FOREIGN PATENT DOCUMENTS

| | | | |
|---|---|---|---|
| JP | 09-147731 | A | 6/1997 |
| JP | 2000-133114 | A | 12/2000 |

*Primary Examiner* — Thanh Tam Le

(74) *Attorney, Agent, or Firm* — MacMillan, Sobanski & Todd, LLC

(57) ABSTRACT

An electric terminal includes a conductive portion with a base, a box supported on the base, and a plurality of contact arms extending therefrom. The electric terminal also includes a spring portion formed as a separate piece from and supported on the box of the conductive portion. The spring portion includes a contact arm that biases at least one of the plurality of contact arms of the conductive portion and a protective shroud that extends farther from the base of the conductive portion than the contact arms.

19 Claims, 3 Drawing Sheets

(56) References Cited

U.S. PATENT DOCUMENTS

| | | | | | |
|---|---|---|---|---|---|
| 5,226,842 | A | | 7/1993 | Endo et al. | |
| 5,246,390 | A | | 9/1993 | Egenolf | |
| 5,288,252 | A | | 2/1994 | Steinhardt et al. | |
| 5,350,321 | A | | 9/1994 | Takenouchi | |
| 5,416,461 | A | | 5/1995 | Totsuka et al. | |
| 5,427,552 | A | | 6/1995 | Zielinski et al. | |
| 5,437,566 | A | | 8/1995 | Zinn et al. | |
| 5,474,475 | A | | 12/1995 | Yamaguchi | |
| 5,488,346 | A | | 1/1996 | Kondo et al. | |
| 5,573,434 | A | * | 11/1996 | Ittah et al. | 439/839 |
| 5,581,225 | A | | 12/1996 | Oh et al. | |
| 5,591,051 | A | | 1/1997 | Ittah | |
| 5,658,174 | A | | 8/1997 | Benes et al. | |
| 5,662,487 | A | | 9/1997 | Okamura et al. | |
| 5,679,034 | A | | 10/1997 | Hanazaki et al. | |
| 5,695,368 | A | * | 12/1997 | Joly et al. | 439/748 |
| 5,716,245 | A | | 2/1998 | Kameyama et al. | |
| 5,739,741 | A | | 4/1998 | Hanazaki et al. | |
| 5,745,024 | A | | 4/1998 | Ohta et al. | |
| 5,795,193 | A | | 8/1998 | Yang | |
| 5,863,225 | A | * | 1/1999 | Liebich et al. | 439/845 |
| 5,868,590 | A | * | 2/1999 | Dobbelaere | 439/839 |
| 5,886,611 | A | | 3/1999 | Schaller et al. | |
| 6,178,106 | B1 | | 1/2001 | Umemoto et al. | |
| 6,431,880 | B1 | | 8/2002 | Davis et al. | |
| 6,506,060 | B2 | | 1/2003 | Sumida et al. | |
| 6,558,198 | B2 | | 5/2003 | Kobayashi et al. | |
| 6,659,783 | B2 | * | 12/2003 | Copper et al. | 439/181 |
| 6,759,938 | B2 | | 7/2004 | Matsumura et al. | |
| 6,824,430 | B2 | | 11/2004 | Matsumura et al. | |
| 6,872,103 | B1 | | 3/2005 | Flieger et al. | |
| 7,048,597 | B2 | * | 5/2006 | Chen | 439/851 |
| 7,071,808 | B2 | | 7/2006 | Nakamura | |
| 7,252,559 | B1 | * | 8/2007 | Morello et al. | 439/843 |
| 7,592,892 | B2 | | 9/2009 | Ito et al. | |
| 7,595,715 | B2 | | 9/2009 | Pavlovic et al. | |
| 7,612,647 | B2 | | 11/2009 | Onoda et al. | |
| 7,789,720 | B2 | * | 9/2010 | Zinn | 439/845 |
| 7,845,993 | B2 | * | 12/2010 | Falchetti | 439/843 |
| 7,876,193 | B2 | * | 1/2011 | Pavlovic et al. | 337/229 |
| 7,892,050 | B2 | | 2/2011 | Pavlovic et al. | |
| 8,475,220 | B2 | * | 7/2013 | Glick et al. | 439/839 |
| 2004/0124963 | A1 | | 7/2004 | Nakamura | |
| 2006/0205267 | A1 | | 9/2006 | Darr et al. | |
| 2008/0224814 | A1 | | 9/2008 | Pavlovic et al. | |

* cited by examiner

TERMINAL WITH FRONT END PROTECTION

CROSS-REFERENCE TO RELATED APPLICATIONS

This application claims the benefit of U.S. Provisional Application No. 61/786,726, filed Mar. 15, 2013, the disclosure of which is incorporated herein by reference.

BACKGROUND OF THE INVENTION

This invention relates in general to an electric terminal. More particularly, this invention relates to an electric terminal that includes features to protect the conductive components of the terminal from damage.

Electric terminals are commonly used to create an electric connection between electric components, for example to connect a component to a power source. A pair of complementary electric terminals includes two electrically-conductive components that are brought into engagement with each other. Damage to one of the electrically-conductive components can impair the ability of the terminal to provide an adequate electric connection. Therefore, care must be taken not to damage either of the electrically-conductive components. It would be desirable to have an electric terminal that helps prevent damage to the electrically-conductive components.

SUMMARY OF THE INVENTION

This invention relates to an electric terminal. The electric terminal includes a conductive portion with a base and a plurality of contact arms extending therefrom. The electric terminal includes a protective shroud that extends farther from the base than the contact arms do.

This invention further relates to an electric terminal. The electric terminal includes a conductive portion that has a base and a plurality of contact arms extending therefrom. The electric terminal has a spring portion made of an electrically conductive material. The spring portion is configured to bias at least one of the plurality of contact arms in an inward direction. The spring portion includes a protective shroud that extends farther from the base than the contact arms do.

This invention further relates to an electric terminal. The electric terminal includes a conductive portion with a base and a plurality of contact arms extending therefrom. The electric terminal includes a spring portion made of an electrically conductive material. The spring portion is configured to bias at least one of the plurality of contact arms in an inward direction. The spring portion includes a protective shroud that extends farther from the base than the contact arms do. There is at least one projection on the protective shroud. The protective shroud defines a shroud opening. The shroud opening is configured so that a second terminal that mates with the plurality of contact arms of the electric terminal will pass through the shroud opening. The at least one projection on the protective shroud narrows the size of the shroud opening.

Various aspects of this invention will become apparent to those skilled in the art from the following detailed description of the preferred embodiments, when read in light of the accompanying drawings.

DETAILED DESCRIPTION OF THE PREFERRED EMBODIMENT

Figure 1:
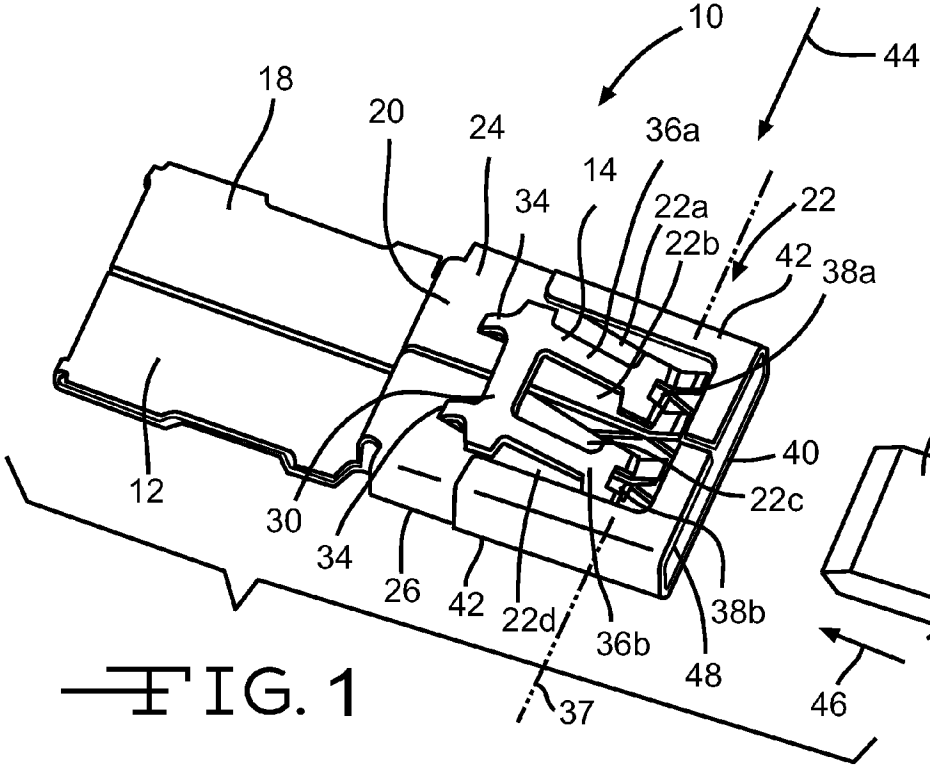
FIG. 1 is a perspective view of an electric terminal including an end protection.

Referring now to the drawings, there is illustrated in FIG. 1 an electric terminal indicated generally at 10. The illustrated terminal 10 includes two components that are made of two different materials, namely, a conductive portion 12 and a spring portion 14. The terminal 10 is a female terminal that is designed to mate with a complementary second terminal, such as a male blade terminal 16, in order to establish an electric connection between the terminal 10 and the blade terminal 16. The conductive portion 12 is configured to engage the blade terminal 16 when the blade terminal 16 is mated with the terminal 10. The conductive portion 12 may be made of a material selected for its desired electrically conductive characteristics, such as, for example, copper, aluminum, an alloy of one of these metals, or any other desired electrically conductive material. The spring portion 14 is configured to bias the conductive portion 12 into contact with the blade terminal 16 when the blade terminal 16 is mated with the terminal 10. The spring portion 14 may be made of a material selected for its desired resilient characteristics, such as stainless steel. The spring portion 14 may also be selected for its electrical conductive characteristics. In the illustrated embodiment, when the terminal 10 is mated with the blade terminal 16 and used to transfer electric current, the conductive portion 12 is primarily designed to conduct current while the spring portion 14 is primarily designed to help maintain contact between the conductive portion 12 and the blade terminal 16. However, the illustrated spring portion 14 also is able to conduct electric current. It should be appreciated that the illustrated terminal 10 is only one embodiment, and the terminal 10 may have a different design from that shown, if desired, and may be made of different materials from those described, if desired. Further, it should be appreciated that the spring portion 14 may be made of the same material as the conductive portion 12, if desired. The electric terminal 10 is similar to the female terminal receptor taught in U.S. Pat. No. 7,892,050, the disclosure of which is hereby incorporated by reference.

The conductive portion 12 includes a base 18 and an attached, generally rectangular box 20. Contact arms, indicated generally at 22, extend from the box 20. The conductive portion 12 may be stamped from a single piece of electrically conductive material and folded into the shape shown. Alternatively, the conductive portion may be made in any other desired manner. Further, the conductive portion 12 may have a different shape from that illustrated, if desired. The illustrated conductive portion 12 includes eight contact arms 22*a* through 22*h*. A first set of contact arms, 22*a* through 22*d*, extends from a first side 24 of the box 20, while a second set of contact arms, 22*e* through 22*h*, extends from a second side 26 of the box 20. The first set of contact arms 22*a*-22*d* and the second set of contact arms 22*e*-22*h* are biased toward each other. When the blade terminal 16 is mated with the electric terminal 10, it is inserted between the first set of conductive arms 22*a*-22*d* and the second set of conductive arms 22*e*-22*h*, and the two sets of contact arms are pushed apart.

The spring portion 14 helps bias first set of contact arms 22*a*-22*d* and the second set of contact arms 22*e*-22*h* toward each other. As previously described, the spring portion 14 is made of a material such as stainless steel that has improved resilient characteristics as compared to the conductive portion 12. The spring portion includes a first cross member 30 located adjacent to the first side 24 of the box 20 and a second cross member 32 located adjacent to the second side 26 of the box 20. A pair of spring bases 34 extends through the box 20 and connects the first cross member 30 and the second cross member 32. The spring portion 14 includes four spring arms 36*a*through 36*d*. The spring arms 36*a*-36*b* extend from the first cross member 30 generally adjacent to the first set of contact arms 22*a*-22*d*, and the spring arms 36*c*-36*d* extend from the second cross member 32 generally adjacent to the second set of contact arms 22*e*-22*h*. Spring arm 36*a* includes a guide 38*a* that serves to align spring arm 36*a* with contact arm 22*a* and contact arm 22*b*. Spring arm 36*a* helps bias contact arm 22*a* and contact arm 22*b*in inward directions. Similarly, each of the spring arms 36*b*-36*d* includes a similar guide 38*b*-38*d*, and each of the spring arms 36*b*-36*d* engages two of the contact arms 22 and helps bias the respective contact arms in the inward direction. It should be appreciated that the inward direction is toward a line 37 shown on FIG. 1. The line 37 is located between the first set of contact arms 22*a*-22*d* and the second set of contact arms 22*e*-22*h*. By biasing the contact arms 22 in the inward direction, the spring portion 14 biases the contact arms 22 into engagement with the blade terminal 16 when it is mated with the electric terminal 10. It should also be appreciated that the illustrated spring portion 14 is only one, non-limiting embodiment, and the spring portion 14 may have a design other than that shown, if desired.

If the contact arms 22 are damaged the electric terminal 10 may not establish a satisfactory electric connection with the blade terminal 16. For example, if one or more of the contact arms 22 is bent from its proper position it may not properly engage the blade terminal 16. The contact arms 22 could be damaged by a side-impact, or the contact arms 22 could be damaged when the electric terminal 10 is improperly mated with the blade terminal 16, for example if the two components are not properly aligned. If the blade terminal 10 is improperly aligned with the contact arms 22, the blade terminal 16 may be improperly pressed against an outer end 28 of one or more of the contact arms 22 and this could undesirably bend one or more of the contact arms 22.

Figure 2:
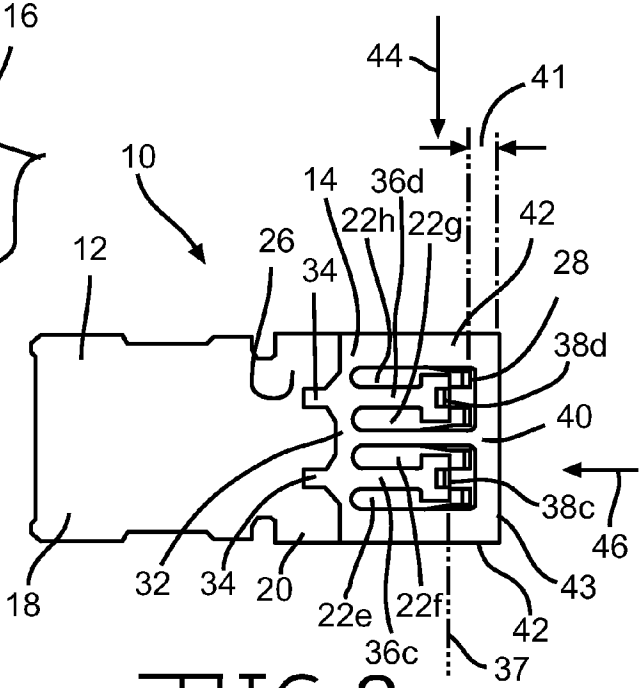
FIG. 2 is a bottom view of the electric terminal shown in FIG. 1.
Figure 4:
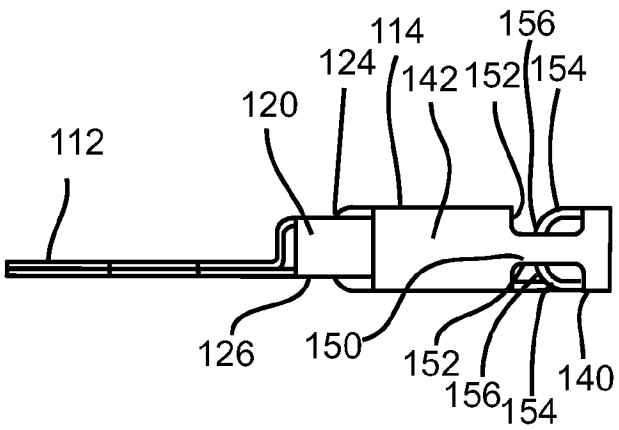
FIG. 4 is a side view of the alternative electric terminal shown in FIG. 3.

In order to help protect the contact arms 22 from damage, the electric terminal 10 includes a protective shroud 40. The protective shroud 40 is connected to the second cross member 32 of the spring portion 14 by a pair of side walls 42. The protective side walls 42 and the protective shroud 40 are stamped as one piece as part of the spring portion 14. However, the protective shroud 40 and the side walls 42 may be separate components, if desired. As best seen in FIG. 2, the protective shroud 40 extends farther from the box 20 than the contact arms 22 do and there is a space 41 between an outer end 43 of the protective shroud 40 and the outer end 28 of the contact arms 22. As shown in FIG. 1, the protective shroud 40 and the side walls 42 help protect the contact arms 22 from being struck from a side direction 44, or a front direction 46. Thus, the protective shroud 40 provides side protection and front end protection for the electric terminal 10. Additionally, the protective shroud 40 defines a shroud opening 48. When the blade terminal 16 is mated with the electric terminal 10, it is passed through the shroud opening 48. Thus, the shroud opening 48 serves to limit the amount of potential misalignment between the blade terminal 16 and the electric terminal 10. Thus, the protective shroud 40 helps to assure that the blade terminal 16 is properly aligned with the contact arms 22 when the blade terminal 16 is mated with the electric terminal 10. This helps to limit the potential for the contact arms 22 to be damaged during mating of the electric terminal 10 and the blade terminal 16.

Figure 3:
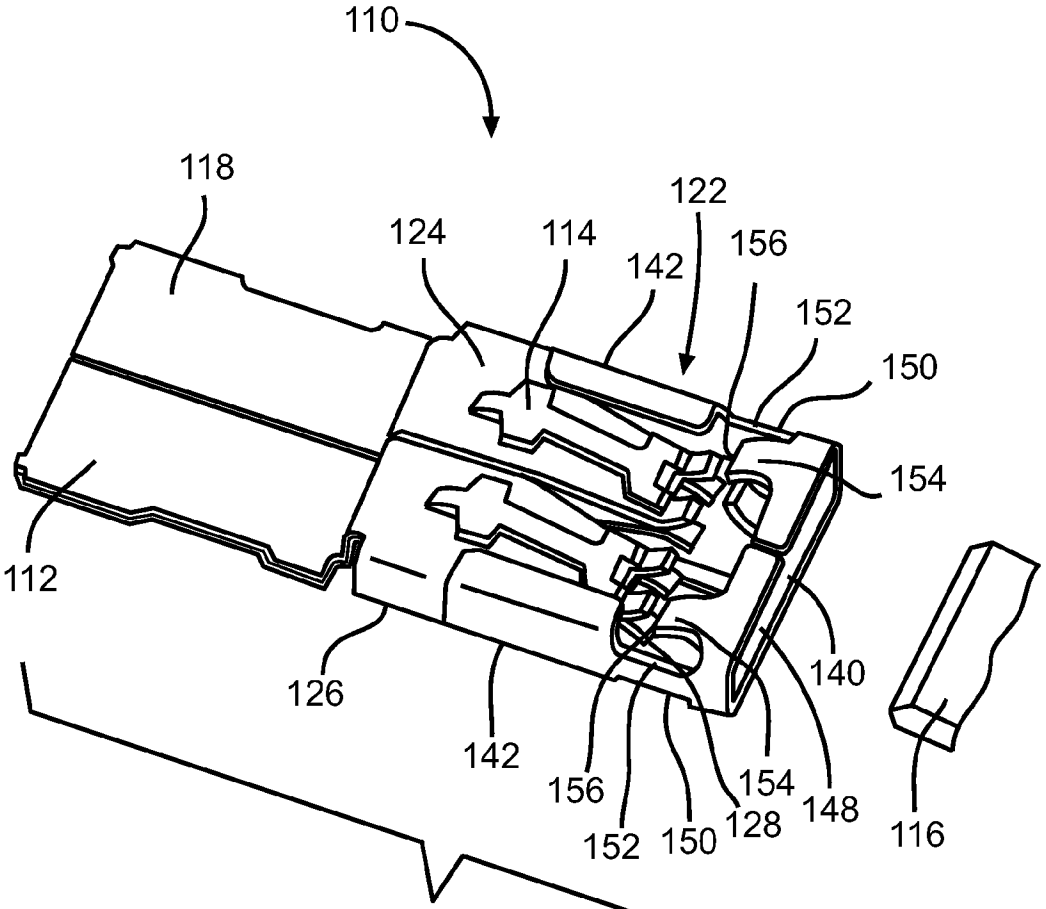
FIG. 3 is a perspective view of an alternative electric terminal that includes an alternative end protection.
Figure 6:
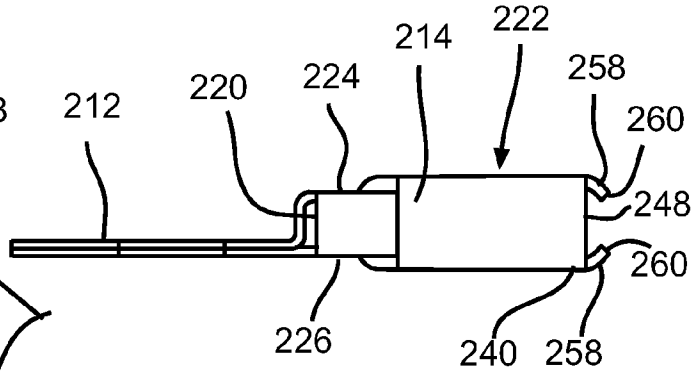
FIG. 6 is a side view of the second alternative electric terminal shown in FIG. 5.

Referring now to FIG. 3, there is illustrated an alternative electric terminal, indicated generally at 110. The alternative electric terminal 110 includes many components similar to those in the electric terminal 10, and similar components are identified with a similar number but with a 100 prefix. However, it should be appreciated that the features of the alternative electric terminal 110 may be different from those illustrated, if desired.

The alternative electric terminal 110 includes a spring portion 114 with a protective shroud 140 and side walls 142. The side walls 142 include optional narrowed portions 150 that define openings or windows 152. As can be seen in a comparison between FIG. 3 and FIG. 1, the windows 152 increase the visibility of outer ends 128 of contact arms 122. This makes it easier for a user to properly align a blade terminal 116 with the contact arms 122 when the blade terminal 116 is mated with the alternative electric terminal 110. The illustrated narrow portion 150 is located in the center of the side wall 142, and defines two equally-sized windows 152. However, the side wall 142 may include different sized windows, or a different number of windows, if desired.

The spring portion 114 also includes optional rearward guides 154. The rearward guides 154 are projections on the protective shroud 140 that extend from the protective shroud 140 toward the contact arms 122. The rearward guides 154 are arranged in opposed pairs, one rearward guide of each pair on a first side 124 of the alternative electric terminal 110 and the other rearward guide on a second side 126 of the alternative electric terminal 110. The members of each pair of rearward guides 154 are closer to each other at distal ends 156 than they are at the protective shroud 140. Thus, the rearward guides 154 serve to narrow the effective size of a shroud opening 148. When the blade terminal 116 is mated with the alternative electric terminal 110, it is passed through the shroud opening 148. Thus, the rearward guides 154 serve to further limit the amount of potential misalignment between the blade terminal 116 and the alternative electric terminal 110.

Figure 5:
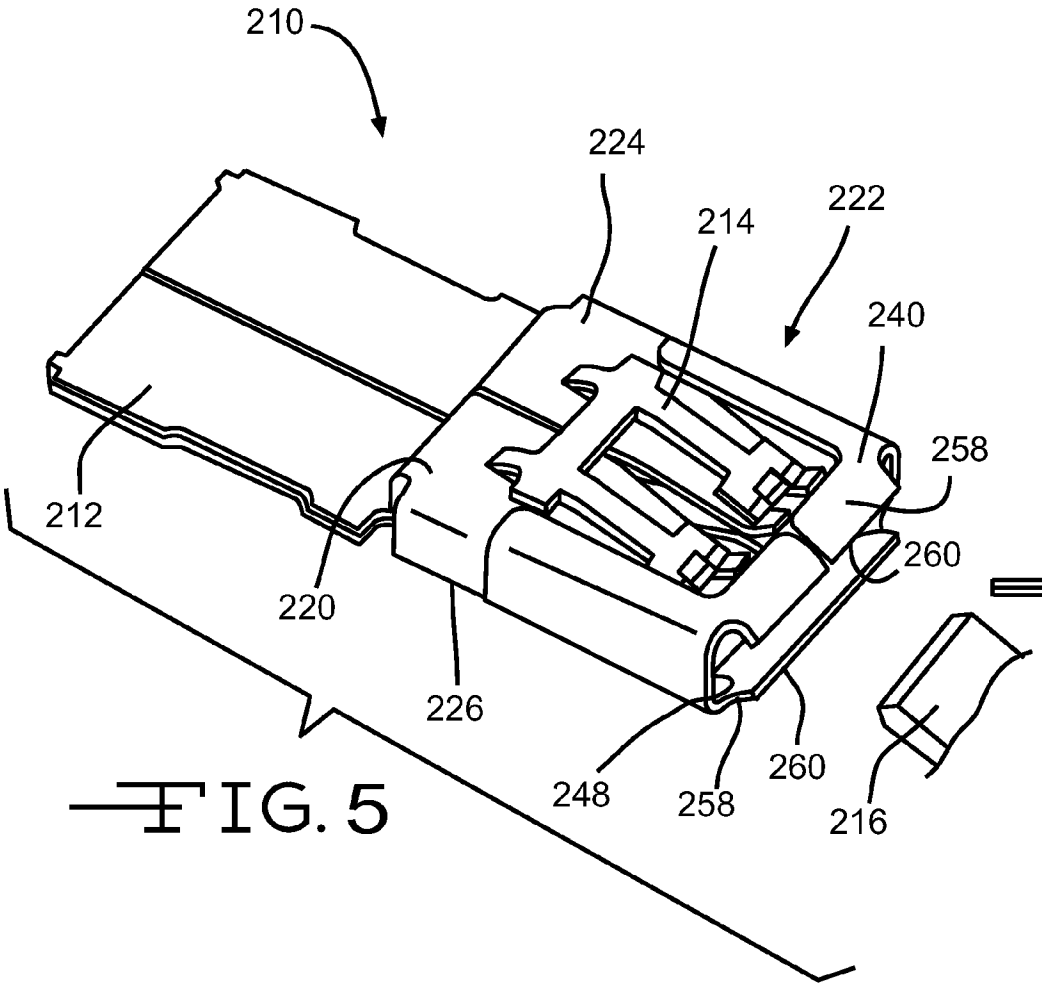
FIG. 5 is a perspective view of a second alternative electric terminal that includes a second alternative end protection.

Referring now to FIG. 5, there is illustrated a second alternative electric terminal, indicated generally at 210. The alternative electric terminal 210 includes many components similar to the electric terminal 10, and similar components are identified with a similar number but with a 200 prefix. However, it should be appreciated that the features of the second alternative electric terminal 210 may be different from those illustrated, if desired.

The second alternative electric terminal 210 includes a spring portion 214 with optional forward guides 258. The forward guides 258 are projections on a protective shroud 240 that extend from the protective shroud 240 away from contact arms 222 (to the right as viewed in FIG. 5). The forward guides 258 are arranged with one adjacent to a first side 224 of the second alternative electric terminal 210 and the other adjacent to a second side 226 of the second alternative electric terminal 210. The forward guides 258 are closer to each other at distal ends 260 than they are at the protective shroud 240. Thus, the forward guides 258 serve to narrow the effective size of a shroud opening 248. When a blade terminal 216 is mated with the second alternative electric terminal 210, it is passed through the shroud opening 248. Thus, the forward guides 258 serve to further limit the amount of potential misalignment between the blade terminal 216 and the second alternative electric terminal 210.

Although not shown in the illustrated embodiment, it should be appreciated that the spring member 214 of the second alternative electric terminal 210 may include windows similar to the windows 152 shown on the alternative electric terminal 110 above, if desired.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electric terminal comprising:

a conductive portion formed from an electrically conductive material and including a base, a box supported on the base, and a plurality of contact arms extending from the box; and a spring portion formed as a separate piece from the conductive portion and supported on the box of the conductive portion, the spring portion including (1) a spring arm that biases at least one of the plurality of contact arms of the conductive portion, and (2) a protective shroud that extends farther from the base of the conductive portion than the plurality of contact arms and the protective shroud does not contact the conductive portion.

2. The electric terminal defined in claim 1 wherein the base, the box, and the plurality of contact arms are formed from a single piece of electrically conductive material.

3. The electric terminal defined in claim 1 wherein the spring arm and the protective shroud are formed from a single piece of material.

4. The electric terminal defined in claim 1 wherein the spring portion biases at least two of the plurality of contact arms toward one another.

5. The electric terminal defined in claim 4 wherein the spring arm and the protective shroud are formed from a single piece of material.

6. The electric terminal defined in claim 1 wherein the box portion has a pair of side walls.

7. The electric terminal defined in claim 6 wherein at least one of the side walls includes at least one narrowed portion that defines a window.

8. The electric terminal defined in claim 6 wherein each of the side walls includes at least one narrowed portion that defines a window.

9. The electric terminal defined in claim 6 wherein the protective shroud includes a guide that extends toward the base of the conductive portion.

10. The electric terminal defined in claim 6 wherein the protective shroud includes a plurality of guides that each extend toward the base of the conductive portion.

11. The electric terminal defined in claim 6 wherein the protective shroud includes a projection that extends toward the base of the conductive portion.

12. The electric terminal defined in claim 6 wherein the protective shroud includes a plurality of projections that each extend toward the base of the conductive portion.

13. An electric terminal comprising:

a conductive portion formed from an electrically conductive material and including a base, a box supported on the base, and an opposed pair of contact arms extending from the box; and a spring portion formed as a separate piece from the conductive portion and supported on the box of the conductive portion, the spring portion including (1) a pair of opposed spring arms that biases the opposed pair of contact arms of the conductive portion toward one another, and (2) a protective shroud that extends farther from the base of the conductive portion than the opposed pair of contact arms and the protective shroud does not contact the conductive portion.

14. The electric terminal defined in claim 13 wherein the conductive portion includes a plurality of opposed pairs of contact arms extending from the box, and wherein the spring portion includes a plurality of pairs of opposed spring arms that each respectively bias the opposed pairs of contact arms of the conductive portion toward one another.

15. The electric terminal defined in claim 13 wherein the base, the box, and the plurality of contact arms are formed from a single piece of electrically conductive material.

16. The electric terminal defined in claim 13 wherein the spring arm and the protective shroud are formed from a single piece of material.

17. The electric terminal defined in claim 13 wherein the box portion has a pair of side walls.

18. The electric terminal defined in claim 13 wherein the protective shroud includes a projection that extends toward the base of the conductive portion.

19. An electric terminal comprising:

a conductive portion formed from an electrically conductive material and including a base, a box supported on the base, and a plurality of contact arms extending from the box;

a spring portion formed as a separate piece from the conductive portion and supported on the box of the conductive portion, the spring portion including (1) a pair of opposed spring arms that biases the plurality of contact arms toward one another, and (2) a spring base that extends through the box connecting the opposed spring arms together;

a protective shroud that extends farther from the base of the conductive portion than the opposed pair of contact arms and the protective shroud does not contact the conductive portion.

* * * * *